US006959691B2

(12) United States Patent
Ueda et al.

(10) Patent No.: US 6,959,691 B2
(45) Date of Patent: Nov. 1, 2005

(54) DEVICE AND METHOD FOR CONTROLLING AIR VOLUME DURING IDLE OPERATION

(75) Inventors: Katsunori Ueda, Okazaki (JP); Hideyuki Handa, Okazaki (JP); Kenichi Nakamori, Okazaki (JP)

(73) Assignee: Mitsubishi Jidosha Kogyo Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/874,380

(22) Filed: Jun. 24, 2004

(65) Prior Publication Data

US 2005/0022782 A1 Feb. 3, 2005

(30) Foreign Application Priority Data

Jun. 26, 2003 (JP) ..... 2003/182732

(51) Int. Cl.[7] ..... F02D 41/16

(52) U.S. Cl. ..... 123/339.21; 123/339.19; 701/110

(58) Field of Search ..... 123/339.14, 339.19, 123/339.2, 339.21, 339.23; 701/110

(56) References Cited

U.S. PATENT DOCUMENTS 6,305,350 B1 * 10/2001 Livshiz et al. ..... 123/339.2

6,820,589 B2 * 11/2004 Okubo et al. ..... 123/339.19

FOREIGN PATENT DOCUMENTS

JP 7-197828 A 8/1995
JP 7-259596 A 10/1995

* cited by examiner

*Primary Examiner*—Tony M. Argenbright
(74) *Attorney, Agent, or Firm*—Birch, Stewart, Kolasch, & Birch, LLP.

(57) ABSTRACT

To permit easy and adequate setting of a gain in an internal combustion engine (hereinafter be called an "engine") for the surer stabilization of an idle speed, the present invention provides a device for controlling an air volume during an idle operation of the engine. This device is provided with a first estimation unit for estimating a current output torque correlation value corresponding to a present intake-air volume of the engine; a second estimation unit for estimating an output torque correlation value correction amount corresponding to a difference between a current engine speed and a target engine speed of the engine; a third estimation unit for estimating a target output torque correlation value based on the correlation value and the correction amount; and a control unit for controlling an intake-air-volume adjusting system of the engine to achieve an intake-air volume which is equivalent to the target output torque correlation value.

22 Claims, 4 Drawing Sheets

DEVICE AND METHOD FOR CONTROLLING AIR VOLUME DURING IDLE OPERATION

This Non-provisional application claims priority under 35 U.S.C. § 119(a) on Patent Application No(s). 2003-182732 filed in JAPAN on Jun. 26, 2003, the entire contents of which are hereby incorporated by reference.

BACKGROUND OF THE INVENTION

1) Field of the Invention

This invention relates to a device and method for controlling an air volume during an idle operation of an internal combustion engine such that an intake-air volume of the internal combustion engine can be adjusted to stabilize an engine speed of the internal combustion engine during the idle operation.

2) Description of the Related Art

Under conventional idle speed control of an internal combustion engine, which may hereinafter be called an "engine", of a vehicle or the like to stabilize an engine speed during an idle operation that the internal combustion engine is idling under no-load conditions (in other words, under an internal load alone), a throttle valve or bypass valve (for example, an ISC valve) is operated to adjust an intake-air volume of the internal combustion engine. Upon conducting the idle speed control, commonly employed is PID control which makes combined use of a P correction proportionate to differences ΔNe in engine speed, a D correction proportionate to change rates dNe in engine speed and an I correction proportionate to an integral of the differences ΔNe. This PID control calculates a throttle opening correction amount by using the following basic equation.

$$\text{Throttle opening correction amount} = Kp \times \Delta Ne + Kd \times dNe + Ki \times \Sigma(\Delta Ne)$$

where the proportional gain Kp, differential gain Kd and integral gain Ki are tuned based on a real engine.

It is, however, difficult to obtain optimal values for the individual gains Kp, Kd and Ki because they are generally determined as a result of trial and error upon development of the internal combustion engine. Moreover, it is not clear how these gains Kp, Kd and Ki should be altered when the load condition and atmosphere conditions change. Even if one tries to effect gain change-over or gain map replacements, it is difficult to adequately effect these gain change-over or gain map replacements. These problems still remain unsolved in stabilizing an idle speed.

As will be indicated by the following equation, for example, a technique has been developed in recent years to determine a throttle opening correction amount on a basis of an output torque of an internal combustion engine.

$$\text{Throttle opening correction amount} = f(\text{torque correction amount})$$

where f: function map, and $$\text{torque correction amount: } Kp \times \Delta Ne + Kd \times dNe + Ki \times \Sigma(\Delta Ne)$$

Even in the above-described technique, however, no improvements have been achieved in the setting of the individual gains Kp, Kd and Ki, so that it is still difficult to adequately set the individual gains Kp, Kd and Ki.

With the foregoing in view, a further technique has been developed (for example, JP 7-197828 A). According to this technique, a target output torque is estimated by detecting an external load applied on an internal combustion engine and then reading an output torque, which is required to drive the external load, from a map in which output torques are stored corresponding to engine speeds and throttle openings. Based on the target output torque, a target throttle opening is again estimated from the above-described map.

However, the technique such as that disclosed in JP 7-197828 A estimates a target throttle opening on the basis of a map so that an accurate target throttle opening can be hardly estimated when the load conditions and atmosphere conditions change, although this technique is free of the difficulty in setting a gain that has remained as an unsolved problem to date.

SUMMARY OF THE INVENTION

With the above-mentioned problems in view, the present invention has as an object thereof the provision of a device and method for controlling an air volume during an idle operation to permit easy and adequate setting of a gain for the surer stabilization of an idle speed.

To achieve the above-described object, the present invention provides a device for controlling an air volume during an idle operation of an internal combustion engine. The device comprises first estimation means for estimating a current output torque correlation value corresponding to a present intake-air volume of the internal combustion engine during the idle operation of the internal combustion engine; second estimation means for estimating an output torque correlation value correction amount (the expression "output torque correlation value correction amount" as used herein means a "correction amount for an output torque correlation value") corresponding to a difference between a current engine speed and a target engine speed of the internal combustion engine; third estimation means for estimating a target output torque correlation value on a basis of the current output torque correlation value estimated by the first estimation means and the output torque correlation value correction amount estimated by the second estimation means; and control means for controlling an intake-air-volume adjusting system of the internal combustion engine to achieve an intake-air volume which is equivalent to the target output torque correlation value estimated by the third estimation means.

According to the above-described device, the air volume is controlled based on the target output torque correlation value during the idle operation of the internal combustion engine. It is, therefore, possible to surely stabilize the idle speed of the internal combustion engine during the idle operation.

Preferably, the device can further comprise parameter conversion means for converting the target output torque correlation value, which has been estimated by the third estimation means, into a value corresponding to the intake-air volume equivalent to the target output torque correlation value; and the control means can control the intake-air-volume adjusting system of the internal combustion engine to achieve a value which has been obtained by the parameter conversion means and which corresponds to the intake-air volume equivalent to the target output torque correlation value.

For example, the output torque correlation value to be estimated by the first estimation means can be a current output torque corresponding to the present intake-air volume of the internal combustion engine during the idle operation of the internal combustion engine; the output torque correlation value correction amount to be estimated by the second estimation means can be an output torque correction amount corresponding to the difference between the current engine speed and the target engine speed of the internal combustion engine; the third estimation means can comprise a target output torque estimation means for estimating a target output torque on a basis of the current output torque estimated by the first estimation means and the output torque correction amount estimated by the second estimation means; and the control means can control the intake-air-volume adjusting system of the internal combustion engine to achieve an intake-air volume equivalent to the target output torque estimated by the target output torque estimation means. As the air volume can be controlled based on the target output torque during the idle operation of the internal combustion engine, it is possible to surely stabilize the idle speed of the internal combustion engine during the idle operation as mentioned above.

Preferably, the device can further comprise parameter conversion means for converting the target output torque, which has been estimated by the target output torque estimation means, into a throttle opening equivalent to the target output torque; and the control means can control the intake-air-volume adjusting system of the internal combustion engine to achieve an intake-air volume corresponding to the throttle opening which has been obtained by the parameter conversion means and which is equivalent to the target output torque.

Preferably, the current output torque to be estimated by the first estimation means can be estimated as one that varies with a first-order delay, which corresponds to an entire volume of intake pipes in the internal combustion engine and a volume of cylinders in the internal combustion engine, relative to an intake-air volume estimated based on a throttle opening at present. Owing to this feature, the current output torque can be estimated more accurately.

The output torque correction amount to be estimated by the second estimation means can include, for example, an output torque correction amount based on a difference between an output torque corresponding to the target engine speed and an output torque corresponding to the current engine speed.

As an alternative, the output torque correction amount to be estimated by the second estimation means can include, for example, an output torque correction amount in which a restoring force corresponding to a difference between the target engine speed and the current engine speed is taken into consideration.

Preferably, the output torque correction amount to be estimated by the second estimation means can include an output torque correction amount in which a restoring force corresponding to a difference between the target engine speed and the current engine speed is taken into consideration, and it is preferred that in the restoring force, a response delay corresponding to a change in engine speed has been taken into consideration.

The output torque correction amount to be estimated by the second estimation means can include, for example, an output torque correction amount corresponding to a speed derivative which relies upon an internal inertia of the internal combustion engine.

The target output torque to be estimated by the target output torque estimation means can be estimated, for example, by adding a product of the output torque correction amount, which has been estimated by the second estimation means, with a gain to the current output torque estimated by the first estimation means. In this preferred embodiment, the target output torque can be estimated by simply adding only the current output torque subsequent to the multiplication of the output torque correction amount with only one gain K. As a result, the adjustment of the gain K can be considerably facilitated compared with such conventional techniques as described above (namely, those requiring plural gains).

Preferably, the target output torque to be estimated by the target output torque estimation means can be estimated by adding a product of the output torque correction amount, which has been estimated by the second estimation means, with a gain to the current output torque estimated by the first estimation means; and the gain used in the target output torque estimation means can be estimated in accordance with a ratio of a pressure downstream of a throttle to a pressure upstream of the throttle. Even when the load conditions, atmosphere conditions or the like change, the gain K can be set at an appropriate value in accordance with such changes, thereby making it possible to estimate an optimal target output torque commensurate with the load conditions and atmosphere conditions and a throttle opening equivalent to the target output torque.

Preferably, the output torque correlation value to be estimated by the first estimation means can be a throttle opening equivalent to a current output torque corresponding to the present intake-air volume of the internal combustion engine; the output torque correlation value correction amount to be estimated by the second estimation means can be a throttle opening correction amount equivalent to an output torque correction amount corresponding to the difference between the current engine speed and the target engine speed of the internal combustion engine; the third estimation means can comprise a target throttle opening estimation means for estimating a target throttle opening on a basis of a throttle opening equivalent to the current output torque estimated by the first estimation means and the throttle opening correction amount equivalent to the output torque correction amount estimated by the second estimation means; and the control means can control the intake-air-volume adjusting system of the internal combustion engine to achieve the target throttle opening estimated by the target throttle opening estimation means. As the air amount is controlled based on the target throttle opening during the idle operation of the internal combustion engine, the idle speed of the internal combustion engine can be surely stabilized during the idle operation.

To achieve the above-described object, the present invention also provides a method for controlling an air volume during an idle operation of an internal combustion engine. The method comprises a first step of estimating a current output torque correlation value corresponding to a present intake-air volume of the internal combustion engine during the idle operation of the internal combustion engine; a second step of estimating an output torque correlation value correction amount corresponding to a difference between a current engine speed and a target engine speed of the internal combustion engine; a third step of estimating a target output torque correlation value on a basis of the current output torque correlation value estimated in the first step and the output torque correlation value correction amount estimated in the second step; and a fourth step of controlling an intake-air-volume adjusting system of the internal combustion engine to achieve an intake-air volume which is equivalent to the target output torque correlation value estimated in the third step.

According to the above-described method, the air volume is controlled based on the target output torque correlation value during the idle operation of the internal combustion engine. It is, therefore, possible to surely stabilize the idle speed of the internal combustion engine during the idle operation.

Preferably, the method can further comprise a conversion step of converting the target output torque correlation value, which has been estimated in the third step, into a value corresponding to the intake-air volume equivalent to the target output torque correlation value; and the fourth step can control the intake-air-volume adjusting system of the internal combustion engine to achieve a value which has been obtained in the conversion step and which corresponds to the intake-air volume equivalent to the target output torque correlation value.

For example, the output torque correlation value to be estimated in the first step can be a current output torque corresponding to the present intake-air volume of the internal combustion engine during the idle operation of the internal combustion engine; the output torque correlation value correction amount to be estimated in the second step can be an output torque correction amount corresponding to the difference between the current engine speed and the target engine speed of the internal combustion engine; the third step can estimate a target output torque on a basis of the current output torque estimated in the first step and the output torque correction amount estimated in the second step; and the fourth step can control the intake-air-volume adjusting system of the internal combustion engine to achieve an intake-air volume equivalent to the target output torque estimated in the third step. As the air volume can be controlled based on the target output torque during the idle operation of the internal combustion engine, it is possible to surely stabilize the idle speed of the internal combustion engine during the idle operation as mentioned above.

Preferably, the method can further comprise a conversion step of converting the target output torque, which has been estimated in the third step, into a throttle opening equivalent to the target output torque; and the fourth step can control the intake-air-volume adjusting system of the internal combustion engine to achieve an intake-air volume corresponding to the throttle opening which has been obtained in the conversion step and which is equivalent to the target output torque.

Preferably, the current output torque to be estimated in the first step can be estimated as one that varies with a first-order delay, which corresponds to an entire volume of intake pipes in the internal combustion engine and a volume of cylinders in the internal combustion engine, relative to an intake-air volume estimated based on a throttle opening at present. Owing to this feature, the current output torque can be estimated more accurately.

The output torque correction amount to be estimated in the second step can include, for example, an output torque correction amount based on a difference between an output torque corresponding to the target engine speed and an output torque corresponding to the current engine speed.

As an alternative, the output torque correction amount to be estimated in the second step can include, for example, an output torque correction amount in which a restoring force corresponding to a difference between the target engine speed and the current engine speed is taken into consideration.

Preferably, the output torque correction amount to be estimated in the second step includes an output torque correction amount in which a restoring force corresponding to a difference between the target engine speed and the current engine speed is taken into consideration, and it is preferred that in the restoring force, a response delay corresponding to a change in engine speed has been taken into consideration.

The output torque correction amount to be estimated in the second step can include an output torque correction amount corresponding to a speed derivative which relies upon an internal inertia of the internal combustion engine.

Preferably, the output torque correlation value to be estimated in the first step can be a throttle opening equivalent to a current output torque corresponding to the present intake-air volume of the internal combustion engine; the output torque correlation value correction amount to be estimated in the second step can be a throttle opening correction amount equivalent to an output torque correction amount corresponding to the difference between the current engine speed and the target engine speed of the internal combustion engine; the third step can estimate a target throttle opening on a basis of a throttle opening equivalent to the current output torque estimated in the first step and the throttle opening correction amount equivalent to the output torque correction amount estimated in the second step; and the fourth step can control the intake-air-volume adjusting system of the internal combustion engine to achieve the target throttle opening estimated in the third step. As the air amount is controlled based on the target throttle opening during the idle operation of the internal combustion engine, the idle speed of the internal combustion engine can be surely stabilized during the idle operation.

DESCRIPTION OF THE PREFERRED EMBODIMENTS

With reference to the drawings, embodiments of the present invention will be described hereinafter.

[First Embodiment]

Figure 1:
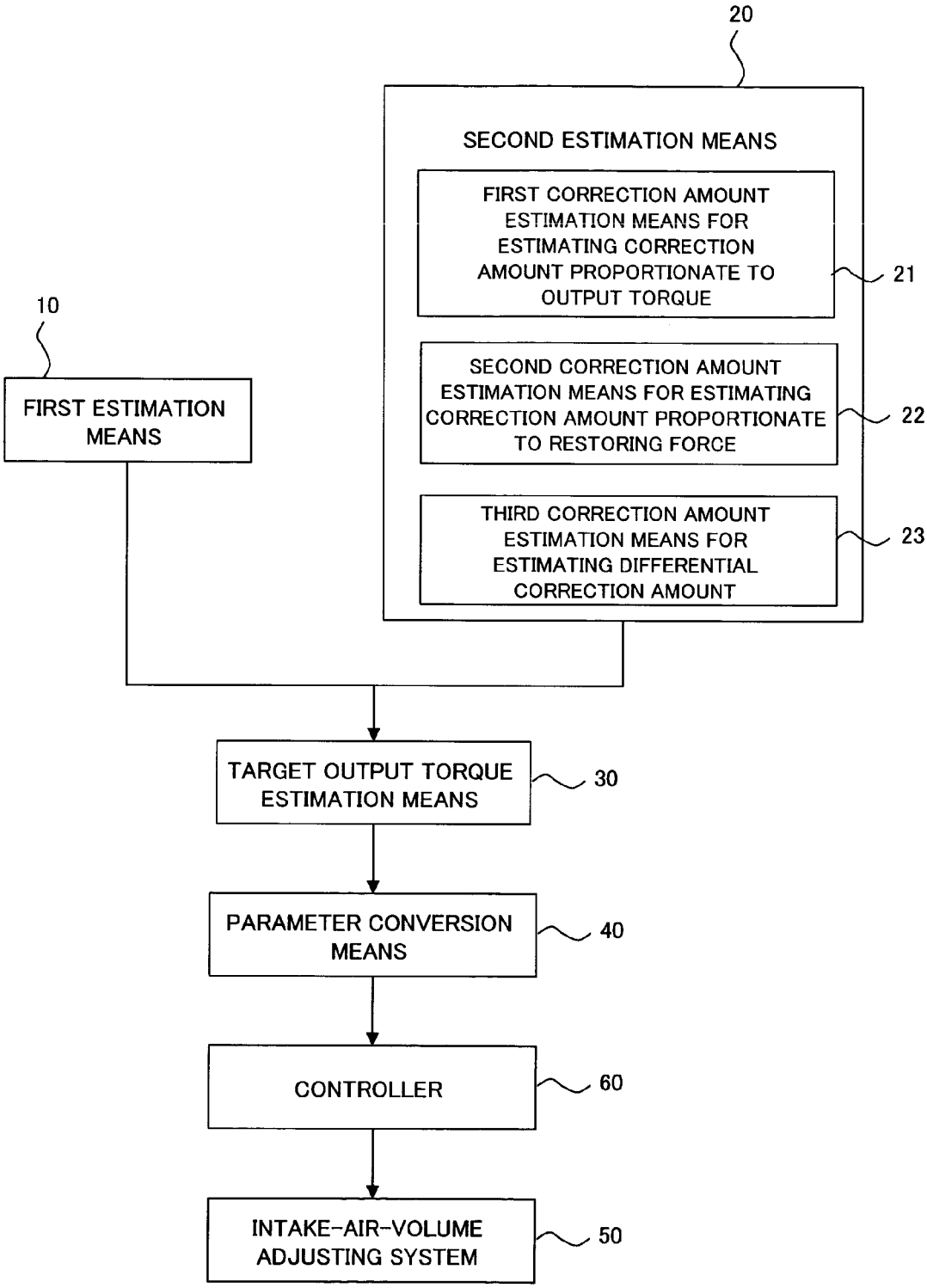
FIG. 1 is an overall construction diagram showing a control device according to a first embodiment of the present invention for an air volume during an idle operation.
Figure 2:
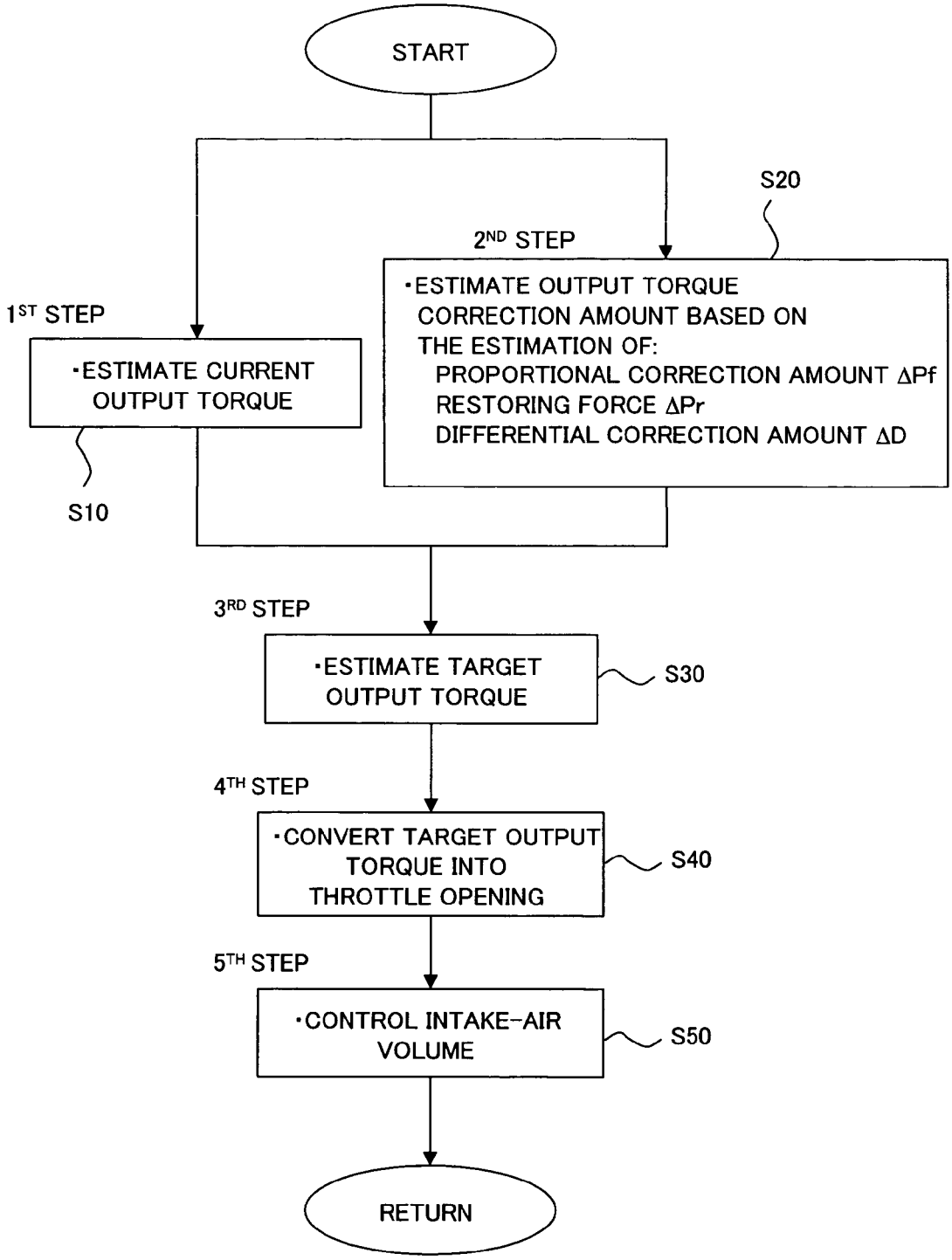
FIG. 2 is a flowchart illustrating a control method according to the first embodiment of the present invention for an air volume during an idle operation.

Firstly, a description will be made about the device and method according to the first embodiment of the present invention for controlling an air volume during an idle operation. FIGS. 1 and 2 show the control device and method according to the first embodiment of the present invention, and FIG. 1 is an overall construction diagram of the control device while FIG. 2 is a flow chart of the control method.

As shown in FIG. 1, the control device according to this embodiment is constructed of first estimation means 10 for estimating a current output corresponding to a present intake-air volume (which may hereinafter be simply called an "air volume") of an internal combustion engine idle-operated on the basis of a target engine speed (target rpm); second estimation means 20 for estimating an output torque correction amount (correction value) corresponding to a difference between a current engine speed and the target engine speed; target output torque estimation means (third estimation means) 30 for estimating a target output torque on the basis of the current output torque estimated by the first estimation means 10 and the output torque correction amount estimated by the second estimation means 20; parameter conversion means 40 for converting the target output torque into a throttle opening equivalent to the target output torque; and a controller 60 as control means for controlling an intake-air-volume adjusting system 50, which is composed of an actuator for a throttle valve that adjusts the volume of intake air to the internal combustion engine, on the basis of the throttle opening.

During an idle operation, an internal combustion engine is operated based on a target engine speed. Due to under/over adjustments of an intake-air volume by a throttle valve (variations in air volume), variations in friction, and the like, however, the actual engine speed of the internal combustion engine may differ from the target engine speed. In such a case, it is necessary to correct an output torque, which corresponds to an internal friction of the internal combustion engine at the actual engine speed, to an output torque which can oppose to an internal friction corresponding to the target engine speed.

Based on the fact that during an idle operation, an output torque is substantially proportional to an intake-air volume, the control device according to this embodiment, therefore, adjusts the intake-air volume such that the output torque of the internal combustion engine becomes equal to an output torque corresponding to a target engine speed. Specifically, an actual (current) output torque of the internal combustion engine, which is operated based on the above-described target engine speed, is estimated at the first estimation means 10. At the second estimation means 20, an output torque correction amount is estimated from a proportional correction amount based on a difference between an output torque corresponding to the target engine speed and an output torque corresponding to a current engine speed, a proportional correction amount for a restoring force which is reverse proportionate to a difference in engine speed produced upon changing of the engine speed, and a differential correction amount obtained by multiplying the rate of a change in engine speed with the internal inertia of the internal combustion engine.

Based on these current output torque and output torque correction amount, a target output torque is then estimated to control the intake-air-volume adjusting system such that an intake-air volume corresponding to the target output torque is achieved.

Incidentally, the output torque HPobj corresponding to the target engine speed can be determined as one corresponding to the current engine sped Nobj and an intra-manifold pressure Pb of the internal combustion engine, for example, by the following equation (1):

$$HPobj=f_1[Nobj,Pb] \quad (1)$$

where $f_1$ is a corresponding function. This computation is performed with reference to a map set beforehand. In this case, the output torque HPobj can be precisely calculated when an intra-manifold pressure during a stable operation at the target engine speed is used as the intra-manifold pressure Pb. However, the intra-manifold pressure during the stable operation at the target engine speed cannot be determined by any calculation. In this embodiment, the output torque HPobj corresponding to the target engine speed is, therefore, calculated by using the current intra-manifold pressure Pb. The use of the output torque HPobj calculated as described above is not considered to cause any problem in practical use.

A description will firstly be made about the first estimation means 10. At the first estimation means 10, a current output torque corresponding to a present intake-air volume of the internal combustion engine is estimated based on a current throttle opening detected from a throttle position sensor.

By a change in throttle opening, the flow rate of intake air passing through the throttle valve varies. On the volume of intake air to be inducted actually into the internal combustion engine, however, a response delay which corresponds to an entire volume of intake pipes and a volume of cylinders in the internal combustion engine takes place relative to the flow rate of intake air passing through the throttle valve because the intake air spreads to fill up the whole intake pipes.

At the first estimation means 10, it is hence designed to estimate the current output torque of the internal combustion engine under the assumption that the current output torque of the internal combustion engine would vary with a first-order delay, which corresponds to the entire volume of the intake pipes and the volume of the cylinders in the internal combustion engine, relative to the intake-air volume estimated based on the current throttle opening.

The present flow rate (estimated intake-air volume) Pos of intake air passing through the throttle valve as estimated at this time at the first estimation means 10 is determined by the following equation (2) as a flow rate corresponding to the throttle opening TPS detected by the throttle position sensor:

$$Pos=f_2[TPS] \quad (2)$$

where $f_2$ is a corresponding function. This computation is performed with reference to a map set beforehand.

Based on the present flow rate (estimated intake-air volume) Pos of intake air passing through the throttle valve, a provisional current output torque X which is estimated at the first estimation means 10 but in which the above-described response delay is not taken into consideration is next determined by the following equation (3):

$$X=Pos\times\tau \quad (3)$$

where $\tau$ is 180° CA cycle (sec).

Representing by $K_{ANF}$ a factor of the first-order delay corresponding to the entire volume of the intake pipes and the volume of the cylinders in the internal combustion engine, the current output torque Y(n) of the internal combustion engine as estimated at the first estimation means 10 is determined by taking into consideration the first-order delay on the estimated intake-air volume Pos as will expressed by the following equation (4):

$$Y(n)=K_{ANF}\cdot Y(n-1)+(1-K_{ANF})\cdot X \quad (4)$$

where the factor $K_{ANF}$ is determined by the following equation (5):

$$K_{ANF}=V_{IM}/(V_{IM}+V_{CYL}) \quad (5)$$

where $V_{IM}$: the entire volume of intake pipes, and $V_{CYL}$: the volume of cylinders in the internal combustion engine.

A description will next be made about the second estimation means 20. As illustrated in FIG. 1, the second estimation means 20 is provided with first correction amount estimation means 21 for estimating a correction amount proportionate to an input torque, second correction amount estimation means 22 for estimating a correction amount proportionate to a restoring force, and a third correction amount estimation means 23 for estimating a differential correction amount.

At the first correction amount estimation means 21, a proportional correction amount ΔPf is calculated based on a difference between the above-described output torque corresponding to the target engine speed and the above-described output torque corresponding to the current engine speed.

Based on the current engine speed Ne of the internal combustion engine and an intra-manifold pressure Pb of the internal combustion engine at present, the current output torque HPe of the internal combustion engine is firstly determined by the following equation (6):

$$HPe=f_2[Ne\cdot Pb] \tag{6}$$

The proportional correction amount ΔPf is determined by the following equation (7) as a difference between the current output torque HPe of the internal combustion engine and the above-described output torque HPobj corresponding to the target engine speed:

$$\Delta Pf=HPobj-HPe \tag{7}$$

At the second correction amount estimation means 22, a restoring force ΔPr—which is produced upon changing of the engine speed and is reverse proportional to the engine speed—is next estimated based on the above-described engine speed Ne.

When the engine speed decreases at a constant throttle opening, the volume of intake air per cycle, said intake air being to be inducted into the cylinders of the internal combustion engine, increases so that the engine speed becomes higher. When the engine speed increases at a constant throttle opening, on the other hand, the volume of intake air per cycle, said intake air being to be inducted into the cylinders of the internal combustion engine, decreases so that the engine speed becomes lower. Even when the engine speed changes, the engine speed is, therefore, restored in reverse proportion to the change in the engine speed owing to these properties. The term "restoring force ΔPr" as used herein means the restored portion of the engine speed as expressed in terms of proportional correction amount.

Under the assumption that this restoring force ΔPr would be produced immediately whenever the engine speed changes, a restoring force ΔPr free of any response delay is estimated here. The restoring force ΔPr estimated at the second correction amount estimation means 22 is, therefore, determined by the following equation (8):

$$\Delta Pr=(Nobj-Ne)/Ne\times HPojb \tag{8}$$

At the third correction amount estimation means 23, a differential correction amount ΔD is then estimated by multiplying the rate of the change in engine speed with an internal inertia of the internal combustion engine. This internal inertia of the internal combustion engine is specific to the internal combustion engine, and is calculated in advance.

Now, the engine speed is firstly determined by the following equation (9):

$$Nei\ [\text{rpm}]=30000/\tau\ [\text{ms}] \tag{9}$$

The rate of the change in engine speed, DNe(n), is then determined by the following equation (10) as a moving average over 2 strokes:

$$DNe(n)=\{Nei(n)-Nei(n-2)\}/2 \tag{10}$$

Defining the rate of the change in engine speed, DNe(n), as a moving average in a single stroke, DNe(n) may also be determined by the following equation (11):

$$DNe(n)=Nei(n)-Nei(n-1) \tag{11}$$

As will be indicated by the following equation (12), the differential correction amount ΔD is then determined by multiplying the rate of the change in engine speed, DNe(n), with an inertia Kle to calculate a rotating torque produced by the inertia, multiplying the rotating torque with the engine speed Ne to obtain a power, and then multiplying the power with the output torque conversion factor $K_{HP}$ to convert the power into an output torque:

$$\Delta D=DNe(n)\times Kle\times Ne\times K_{HP} \tag{12}$$

where the output torque conversion factor $K_{HP}$ is a constant value.

As the output torque correction amount, these proportional correction amount ΔPf, restoring force ΔPr and differential correction amount ΔD are estimated at the second estimation means 20 as described above.

At the target output torque estimation means 30, a target output torque Z subjected to corrections to give an output torque corresponding to the target engine speed is estimated based on the current output torque Y(n) of the internal combustion engine as estimated above at the first estimation means 10 and the output torque correction amounts (specifically, the proportional correction amount ΔPf, restoring force ΔPr and differential correction amount ΔD) as estimated above at the second estimation means 20.

At this target output torque estimation means 30, the target output torque Z is set by the following equation (13):

$$Z=Y(n)+K(\Delta Pf+\Delta Pr+\Delta D) \tag{13}$$

where K is a gain.

Incidentally, this gain K has a predetermined value (for example, 2 to 4). The gain K is changed in accordance with a ratio of a pressure downstream of a throttle to a pressure upstream of the throttle (that is, the intra-manifold pressure (Pb)/atmospheric pressure) and, when this pressure ratio is high, the gain K is also set high.

As readily understood from the foregoing, with respect to the target output torque Z to be estimated at the target output torque estimation means 30, the first-order delay relative to the throttle opening, said first-order delay corresponding to the entire volume of the intake pipes and the volume of the cylinders in the internal combustion engine, is taken into consideration, and the proportional correction for the friction, the proportional correction for the restoration and the differential correction corresponding to the difference in engine speed are applied. Therefore, the target output torque is accurately estimated.

Moreover, it is necessary to set only one gain as the gain K. The setting of this gain K at an optimal value can, therefore, be significantly facilitated upon development or the like of the internal combustion engine.

At the parameter conversion means 40, the target output torque Z is then converted by the following equation (14) into a throttle opening Posobj equivalent to the target output torque:

$$\text{Posobj}=K_{FB}[Z] \tag{14}$$

where $K_{FB}$ is a throttle opening conversion factor.

Upon determining the throttle opening Posobj equivalent to the target output torque Z at the parameter conversion means 40, the target output torque Z may be converted by using a map in which throttle openings are stored beforehand corresponding to output torques and engine speeds.

In the above description, the throttle opening was determined as a parameter corresponding to the target output torque Z. The parameter is, however, not limited to the throttle opening, and any parameter can be used insofar as it corresponds to the intake-air volume of the internal combustion engine. Based on this parameter, the intake-air-volume adjusting mechanism 50 may be controlled by the below-described controller 60 to achieve the target output torque Z.

Based on the above-described throttle opening Posobj corresponding to the target output torque Z, the controller 60 then controls the intake-air-volume adjusting mechanism 50 to perform an adjustment of the volume of air (the volume of intake air) to the internal combustion engine.

A description will next be made about the method according to the first embodiment for controlling an air volume during an idle operation of an internal combustion engine. In a first step S10, a current output torque corresponding to a present intake-air volume of the internal combustion engine is firstly estimated in a similar manner as at the above-described first estimation means 10.

In a second step S20, an output torque correction amount corresponding to a difference between a target engine speed and a current engine speed of the internal combustion engine is then estimated.

This output torque correction amount is the total of a proportional correction amount ΔPf, a restoring force ΔPr and a differential correction amount ΔD. In this method, the proportional correction amount ΔPf is estimated in a similar manner as at the above-described first correction amount estimation means 21, the restoring force ΔPr is estimated in a similar manner as at the above-described second correction amount estimation means 22, and the differential correction amount ΔD is estimated in a similar manner as at the above-described third correction amount estimation means 23.

These proportional correction amount ΔPf, restoring force ΔPr and differential correction amount ΔD are each independently estimated, and no limitation is imposed on the order in which they are estimated.

With respect to the above-described first step S10 and second step S20, no limitation is imposed either on the order in which the current output torque, the proportional correction amount ΔPf, the restoring force ΔPr and the differential correction amount ΔD are estimated. It is only necessary to complete the first step S10 and the second step S20 at least before initiating the below-described third step S30.

In the third step S30, a target output torque is then estimated based on the current output torque estimated above in the first step S10 and the output torque correction amount estimated above in the second step S20 in a similar manner as at the above-described target output torque estimation means 30.

In a fourth step S40, the target output torque estimated in the third step S30 as described above is then converted into a throttle opening corresponding to the target output torque in a similar manner as at the above-described parameter conversion means 40.

In a fifth step S50, the intake-air-volume adjusting system of the internal combustion engine is then controlled based on the throttle opening, which has been obtained above in the fourth step S40, such that an intake-air volume corresponding to the throttle opening can be achieved.

Owing to such features as described above, the control method according to this embodiment makes it possible to accurately control the air volume to an air volume suited for the stabilization of the operation of the internal combustion engine during the idle operation.

As the control device and method according to the first embodiment of the present invention are constructed as mentioned above, the current output torque based on the present intake-air volume estimated at the first estimation means 10 is estimated as an output torque changing with a first-order delay, which corresponds to the entire volume of the intake pipes in the internal combustion engine and the volume of the cylinders in the internal combustion engine, relative to the intake-air volume estimated based on the throttle opening at present. Accordingly, the current output torque can be estimated more accurately.

Further, the output torque correction amount can be precisely estimated at the second estimation means 20, because it includes the proportional correction amount ΔPf based on the difference between the output torque corresponding to the target engine speed and the output torque corresponding to the current engine speed, the restoring force ΔPr produced upon changing of the engine speed and reverse proportional to the change in engine speed difference, and the differential correction amount ΔD obtained by multiplying the rate of the change in engine speed with the internal inertia of the internal combustion engine. As the control of the air volume is conducted based on the output torque correction amount, the idle speed of the internal combustion engine can be more surely stabilized during its idle operation.

Upon estimating the target output torque at the target output torque estimation means 30, it is only necessary to multiply the above-described output torque correction amount with the only one gain K and then to add the product to the above-described current output torque as indicated by the equation (13).

Therefore, the adjustment of this gain K can be considerably facilitated compared with such conventional techniques as described above (namely, those requiring plural gains).

Even when the load conditions, atmosphere conditions or the like change, the gain K can be set at an appropriate value in accordance to such changes, thereby making it possible to estimate an optimal target output torque commensurate with the load conditions and atmosphere conditions and a throttle opening equivalent to the target output torque.

As the intake-air volume is adjusted corresponding to the target output torque estimated as described above, the operation of the internal combustion engine can be stabilized during its idle operation. Even when the engine speed is lowered during the idle operation, the internal combustion engine is hence resistant to a stall so that the fuel economy can be improved.

Even when an internal combustion engine is equipped with a load learning function by arranging a memory unit that learns throttle openings corresponding to variations in load, the conventional techniques such as those described above are difficult to perform the learning because the throttle opening are caused to vary considerably. With the control device according to this embodiment, however, the use of throttle opening as a parameter for adjusting the intake-air volume makes it possible, upon adjusting the intake-air volume, to promptly perform the learning of a load based on a difference from the throttle opening of the internal combustion engine operated based on the target engine speed at the present time before the adjustment.

[Second Embodiment]

A description will next be made about the device and method according to the second embodiment of the present invention for controlling an air volume during an idle operation.

The control device according to this embodiment is similar to the above-described first embodiment except that, even when the engine speed changes, a restoring force ΔPr to be estimated at the second correction amount estimation means 22 in the second estimation means 20 is not produced immediately but is estimated as an actual restoring force ΔPr involving a response delay. Descriptions of the elements of construction and their functions, which are common to both of the embodiments, are omitted accordingly.

Referring now to FIG. 1 of the above-described first embodiment, a description will be made about the control device according to the second embodiment. In this embodiment, those elements of the control device which are the same as or equivalent to corresponding elements in the above-described first embodiment are shown by the same reference numerals.

At the second correction amount estimation means 22 in the second estimation means 20 of the control device according to the second embodiment, the restoring force ΔPr is estimated as an actual restoring force ΔPr which, even when the engine speed changes, is not produced immediately and involves a response delay.

For this estimation, a restoring force ΔPr1 free of any response delay is firstly determined by the following equation (15) in a similar manner as in the case of the equation (8):

$$\Delta Pr1=(Nobj-Ne)/Ne\times HPojb \quad (15)$$

On the other hand, a restoring force portion ΔPrdelay(n) produced with the response delay is determined by the following equation (16) as a factor corresponding to the factor $K_{ANF}$:

$$\Delta Prdelay(n)=K_{ANF}\cdot\Delta Prdelay(n-1)+(1-K_{ANF})\Delta Pr1 \quad (16)$$

The actual restoring force ΔPr with the response delay involved therein is then determined by subtracting the restoring force portion ΔPrdelay(n), which is produced with the response delay, from the restoring force ΔPr1 free of the response delay as expressed by the following equation (17):

$$\Delta Pr=\Delta Pr1-\Delta Pr\mathrm{delay}(n) \quad (17)$$

By subtracting the restoring force portion, which is produced with a response delay, from the restoring force free of any response delay as described above, it is possible to avoid an excessive correction to the current output torque as estimated at the first estimation means.

The control method according to the second embodiment is similar to the above-described control method according to the first embodiment, and therefore, its description is omitted herein.

As the control device and method according to the second embodiment of the present invention are constructed as mentioned above, they can bring about similar advantageous effects as the above-described first embodiment, and moreover, can avoid an application of an excessive correction to the current output torque estimated at the first estimation means 10 because the actual response delay has been taken into consideration in the restoring force ΔPr included in the output torque correction amount estimated at the second estimation means 20. Therefore, the engine speed of the internal combustion engine does not overshoot during an idle operation, thereby making it possible to further stabilize the operation of the internal combustion engine during the idle operation.

[Third Embodiment]

Figure 3:
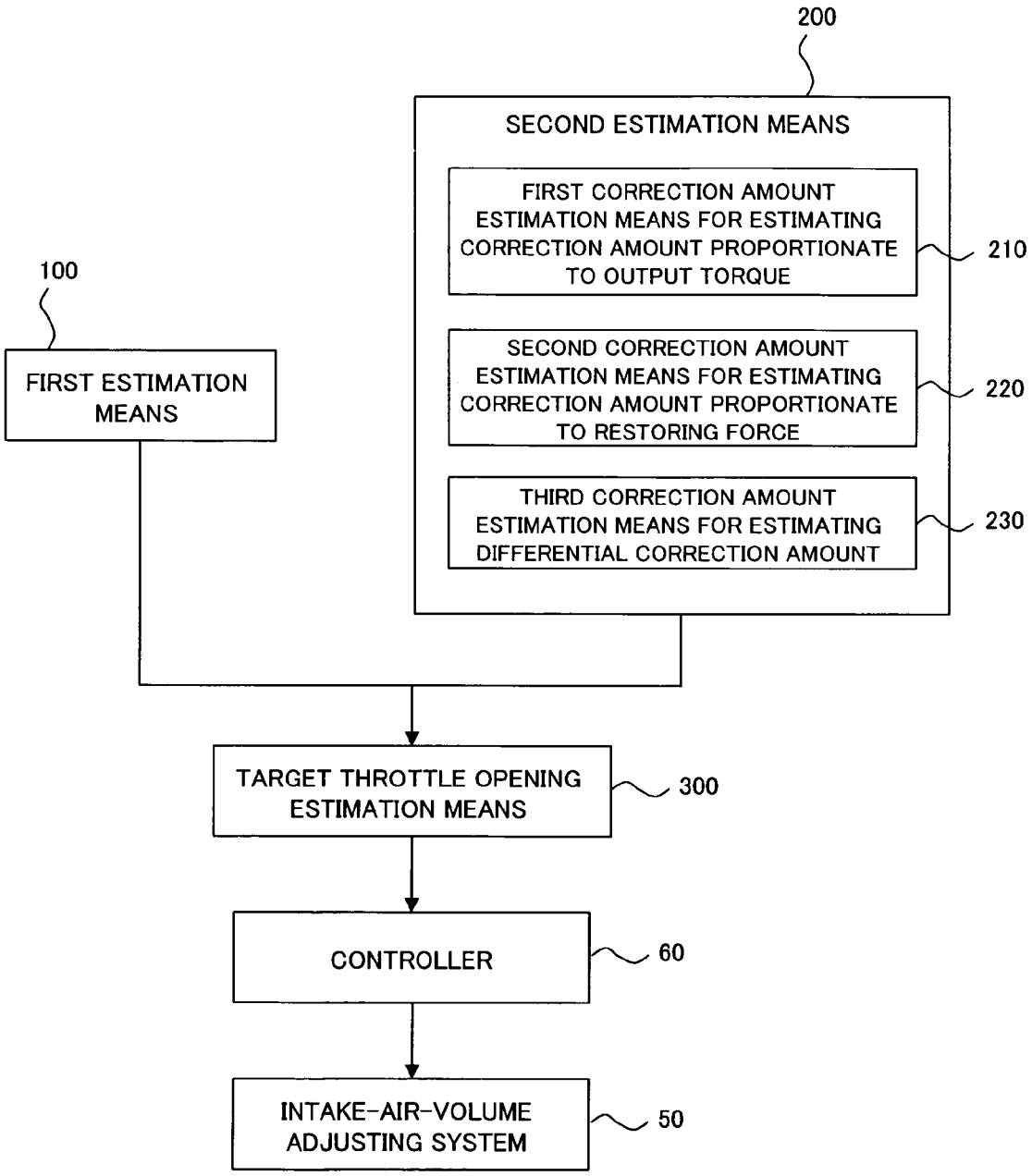
FIG. 3 is an overall construction diagram showing a control device according to a third embodiment of the present invention for an air volume during an idle operation.
Figure 4:
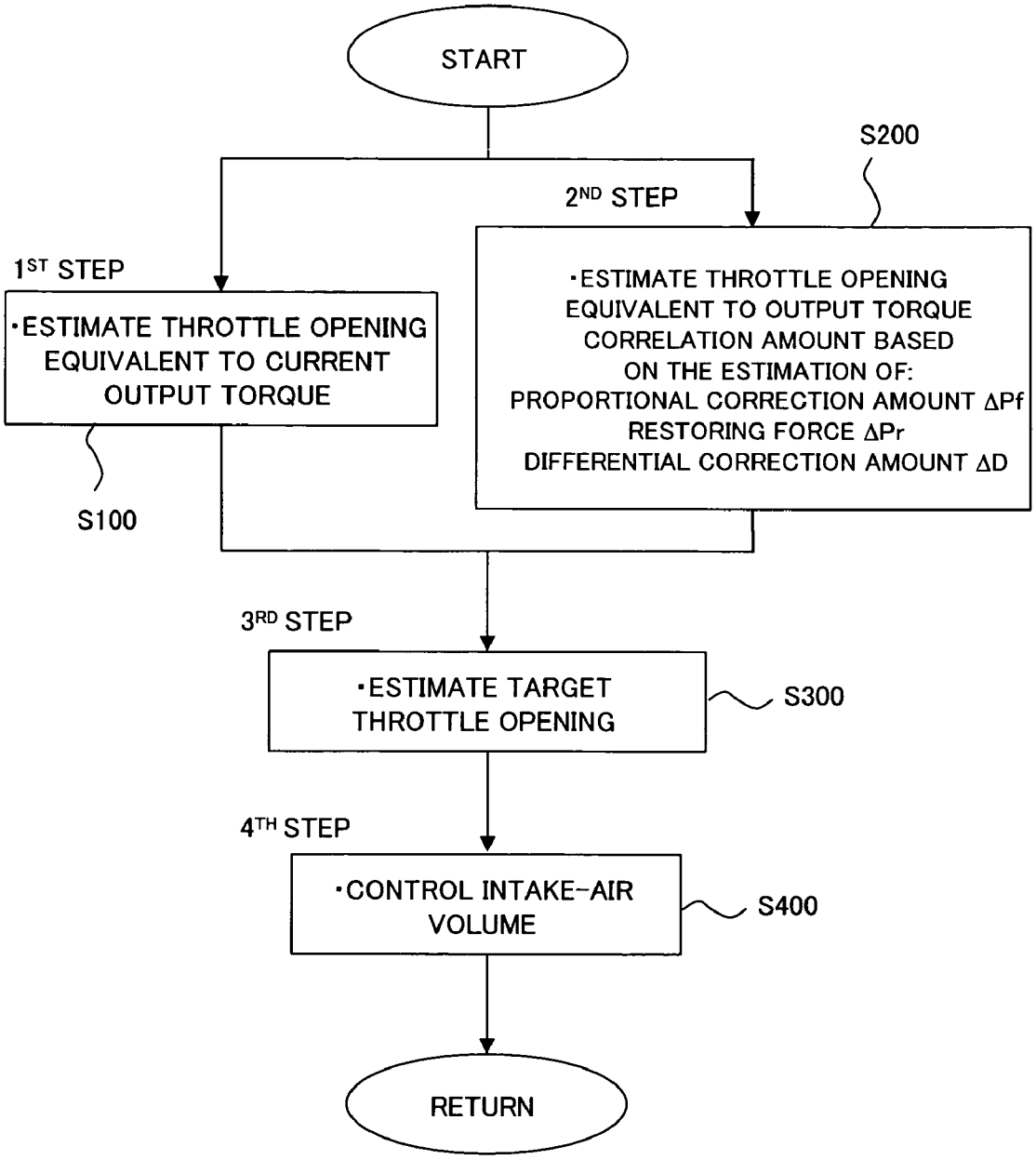
FIG. 4 is a flowchart illustrating a control method according to the third embodiment of the present invention for an air volume during an idle operation.

Next, a description will be made about the device and method according to the third embodiment of the present invention for controlling an air volume during an idle operation. FIGS. 3 and 4 show the control device and method according to the third embodiment of the present invention, and FIG. 3 is an overall construction diagram of the control device while FIG. 4 is a flow chart of the control method.

In the control device according to this embodiment, a current output torque is used at the below-described first estimation means 100 upon estimating a throttle opening as an output torque correlation value equivalent to the current output torque. This current output torque is similar to the output torque Y(n) estimated at the first estimation means 10 in the first embodiment. Further, a proportional correction amount ΔPf, restoring force ΔPr and differential correction amount ΔD are used as output torque correction amounts at the below-described second estimation means 200 upon estimating a throttle opening as an output torque correlation value correction amount equivalent to an output torque correction amount. These proportional correction amount ΔPf, restoring force ΔPr and differential correction amount ΔD are similar to those estimated at the second estimation means 20 in the first embodiment.

With respect to the current output torque and the proportional correction amount ΔPf, restoring force ΔPr and differential correction amount ΔD as output correction amounts, their detailed description is hence omitted herein. In this embodiment, those elements of the control device which are the same as or equivalent to corresponding elements in the above-described first embodiment are shown by the same reference numerals.

As illustrated in FIG. 3, the control device according to this embodiment is constructed of the first estimation means 100 for estimating a throttle opening as an output torque correlation value which is equivalent to a current output torque corresponding to a present intake-air amount of an internal combustion engine operated based on a target engine speed; the second estimation means 200 for estimating a throttle opening as an output torque correlation value correction amount which is equivalent to an output torque correction amount corresponding to a difference between the target engine speed and a current engine speed; a target throttle opening estimation means (third estimation means) 300 for estimating a target throttle opening as a target output torque correlation value, which is equivalent to a target output torque, on the basis of the throttle opening equivalent to the current output torque as estimated at the first estimation means 100 and the throttle opening equivalent to the output torque correction amount as estimated at the second estimation means 200; and a controller 60 as control means for controlling an intake-air-amount adjusting system 50, which is composed of an actuator for a throttle valve that adjusts the volume of intake air to the internal combustion engine, on the basis of the target throttle opening.

At the first estimation means 100, a current output torque Y(n) corresponding to the a present intake-air volume is estimated in a similar manner as at the first estimation means 10 in the first embodiment as shown by the equations (2) to (5).

A throttle opening PosE equivalent to the output torque Y(n) is then determined by the following equation (18):

$$PosE=Y(n)/\tau \quad (18)$$

As illustrated in FIG. 3, the second estimation means 200 is provided with first correction amount estimation means 210 for estimating a throttle opening PosPf equivalent to an output-torque-proportionate correction amount ΔPf which corresponds to a difference between an output torque HPobj corresponding to the target engine speed and an output torque corresponding to the current engine speed (i.e., first correction amount estimation means 210 for estimating a correction amount proportionate to an output torque); second correction amount estimation means 220 for estimating a throttle opening PosPr equivalent to a restoring force ΔPr, which is produced upon changing of the engine speed and is reverse proportional to the engine speed, on the basis of the current engine speed Ne (i.e., second correction amount estimation means 220 for estimating a correction amount proportionate to a restoring force); and third correction amount estimation means 230 for estimating a throttle opening PosD equivalent to a differential correction amount ΔD which is estimated by multiplying the rate of the change in engine speed with an internal inertia of the internal combustion engine (i.e., third correction amount estimation means 230 for estimating a differential correction amount).

At the first correction amount estimation means 210, the output-torque-proportionate correction amount ΔPf is estimated by the equations (6) and (7) in a similar manner as at the first correction amount estimation means 21 in the second estimation means 20 of the first embodiment.

The throttle opening PosPf equivalent to the output-torque-proportionate correction amount ΔPf is then determined by the following equation (19):

$$PosPf=\Delta Pf\times K_{pos} \quad (19)$$

where $K_{pos}$ is a throttle opening conversion factor, and this throttle opening conversion factor $K_{pos}$ is a predetermined value which can be determined corresponding to a ratio of a pressure downstream of a throttle to a pressure upstream of the throttle (that is, the intra-manifold pressure Pb/the atmospheric pressure Patm).

Described specifically, this throttle opening conversion factor $K_{pos}$ is determined by the following equation (20) because the flow rate of intake air and the throttle opening are in a proportional relationship in a range where the ratio of the pressure downstream of the throttle to the pressure upstream of the throttle is in a critical state (the intra-manifold pressure Pb/the atmospheric pressure Patm≦0.52).

$$K_{pos}=1/f_3 \quad (20)$$

where $f_3$ is a corresponding function. This computation is performed with reference to a map set beforehand.

In a range where the ratio of the pressure downstream of the throttle to the pressure upstream of the throttle exceeds the critical state (the intra-manifold pressure Pb/the atmospheric pressure Patm>0.52), the throttle opening conversion factor $K_{pos}$ is determined by the following equation (21):

$$K_{pos}=1/f_4[Pb/Patm] \quad (21)$$

where $f_4$ is a corresponding function. This computation is performed with reference to a map set beforehand.

In the above-described range where the ratio of the pressure downstream of the throttle to the pressure upstream of the throttle exceeds the critical state, the throttle opening conversion factor $K_{pos}$ is set to become smaller as the intra-manifold pressure Pb/the atmospheric pressure Patm approaches from 0.52 toward 1.0.

At the second correction amount estimation means 220, the restoring force ΔPr is then estimated by the equation (8) in a similar manner as at the second correction amount estimation means 22 in the second estimation means 20 of the first embodiment.

The throttle opening PosPr equivalent to the restoring force ΔPr is next determined by the following equation (22):

$$PosPr=\Delta Pr\times K_{pos} \quad (22)$$

At the third correction amount estimation means 230, on the other hand, the differential correction amount ΔD is estimated by the equations (9) to (12) in a similar manner as at the third correction amount estimation means 23 in the second estimation means 20 of the first embodiment.

The throttle opening PosD equivalent to the differential correction amount ΔD is then determined by the following equation (23):

$$PosD=\Delta D\times K_{pos} \quad (23)$$

A description will next be made about the target throttle opening estimation means 300. At this target throttle opening estimation means 300, a target throttle opening Posobj is determined by the following equation (24) on the basis of the throttle opening PosE equivalent to the current output torque estimated at the first estimation means 100 and the throttle openings PosPf, PosPr and PosD equivalent to the output torque correction amounts estimated at the second estimation means 200.

$$Posobj=PosE+K'(PosPf+PosPr+PosD) \quad (24)$$

where K' is a gain, and like the gain K in the equation (13) for the first embodiment, this gain K' is a predetermined value (for example, 2 to 4) but is changed depending on the ratio of the pressure downstream of the throttle to the pressure upstream of the throttle such that the gain K' can also be set high when the pressure ratio is large.

The controller 60 then controls the intake-air-volume adjusting system 50 of the internal combustion engine on the basis of the target throttle opening Posobj to perform an adjustment to the volume of air (the intake-air volume) to the internal combustion engine.

A description will next be made about the control method according to the third embodiment. As illustrated in FIG. 4, a throttle opening as an output torque correlation value, which is equivalent to a current output torque corresponding to a present intake-air volume of the internal combustion engine, is firstly estimated in a first step S100 in a similar manner as at the first estimation means 100.

In a second step S200, a throttle opening as an output torque correlation value correction amount, which is equivalent to a difference between a target engine speed and a current engine speed of the internal combustion engine, is next estimated.

This throttle opening equivalent to the output torque correction amount is the total of the throttle openings equivalent to the proportional correction amount ΔPf, the restoring force ΔPr and the differential correction amount ΔD. In this method, the proportional correction amount ΔPf is estimated in a similar manner as at the first correction amount estimation means 210, the restoring force ΔPr is estimated in a similar manner as at the second correction amount estimation means 220, and the differential correction amount ΔD is estimated in a similar manner as at the third correction amount estimation means 230.

These proportional correction amount ΔPf, restoring force ΔPr and differential correction amount ΔD are each independently estimated, and no limitation is imposed on the order in which they are estimated.

With respect to the above-described first step S100 and second step S200, no limitation is imposed either on the order in which the throttle opening, the proportional correction amount ΔPf, the restoring force ΔPr and the differential correction amount ΔD are estimated. It is only necessary to complete the first step S100 and the second step S200 at least before initiating the below-described third step S300.

In the third step S300, a target throttle opening as a target output torque correlation value equivalent to a target output torque is then estimated based on the throttle opening equivalent to the current output torque estimated above in the first step S100 and the throttle opening equivalent to the output torque correction amount estimated above in the second step S200 in a similar manner as at the above-described target throttle opening estimation means 300.

In a fourth step S400, the intake-air-volume adjusting system of the internal combustion engine is next controlled based on the target throttle opening, which has been estimated above in the third step S300, such that an intake-air volume corresponding to the target throttle opening can be achieved.

Owing to such features as described above, the control method according to the third embodiment makes it possible to accurately control the air volume to an air volume suited for the stabilization of the operation of the internal combustion engine during the idle operation.

As the control device and method according to the third embodiment of the present invention are constructed as mentioned above, they can bring about similar advantageous effects as the above-described first embodiment.

The present invention has been described above on the basis of its embodiments. It should, however, be noted that the present invention is by no means limited to these embodiments but can be practiced with various modifications within a scope not departing from the spirit of the present invention.

For example, the second correction amount estimation means 220 in the second estimation means 200 of the third embodiment may be constructed such that similar to the second embodiment, a restoring force ΔPr to be estimated there is not supposed to occur immediately even when the engine speed changes and is estimated as a restoring force ΔPr involving an actual response delay.

What is claimed is:

1. A device for controlling an air volume during an idle operation of an internal combustion engine, comprising:

first estimation means for estimating a current output torque correlation value corresponding to a present intake-air volume of said internal combustion engine during said idle operation of said internal combustion engine;

second estimation means for estimating an output torque correlation value correction amount corresponding to a difference between a current engine speed and a target engine speed of said internal combustion engine;

third estimation means for estimating a target output torque correlation value on a basis of said current output torque correlation value estimated by said first estimation means and said output torque correlation value correction amount estimated by said second estimation means; and control means for controlling an intake-air-volume adjusting system of said internal combustion engine to achieve an intake-air volume which is equivalent to said target output torque correlation value estimated by said third estimation means.

2. A device according to claim 1, wherein:

said device further comprises parameter conversion means for converting said target output torque correlation value, which has been estimated by said third estimation means, into a value corresponding to said intake-air volume equivalent to said target output torque correlation value; and said control means controls said intake-air-volume adjusting system of said internal combustion engine to achieve a value which has been obtained by said parameter conversion means and which corresponds to said intake-air volume equivalent to said target output torque correlation value.

3. A device according to claim 1, wherein:

said output torque correlation value to be estimated by said first estimation means is a current output torque corresponding to said present intake-air volume of said internal combustion engine during said idle operation of said internal combustion engine;

said output torque correlation value correction amount to be estimated by said second estimation means is an output torque correction amount corresponding to said difference between said current engine speed and said target engine speed of said internal combustion engine;

said third estimation means comprises a target output torque estimation means for estimating a target output torque on a basis of said current output torque estimated by said first estimation means and said output torque correction amount estimated by said second estimation means; and said control means controls said intake-air-volume adjusting system of said internal combustion engine to achieve an intake-air volume equivalent to said target output torque estimated by said target output torque estimation means.

4. A device according to claim 3, wherein:

said device further comprises parameter conversion means for converting said target output torque, which has been estimated by said target output torque estimation means, into a throttle opening equivalent to said target output torque; and said control means controls said intake-air-volume adjusting system of said internal combustion engine to achieve an intake-air volume corresponding to said throttle opening which has been obtained by said parameter conversion means and which is equivalent to said target output torque.

5. A device according to claim 3, wherein:

said current output torque to be estimated by said first estimation means is estimated as one that varies with a first-order delay, which corresponds to an entire volume of intake pipes in said internal combustion engine and a volume of cylinders in said internal combustion engine, relative to an intake-air volume estimated based on a throttle opening at present.

6. A device according to claim 3, wherein:

said output torque correction amount to be estimated by said second estimation means includes an output torque correction amount based on a difference between an output torque corresponding to said target engine speed and an output torque corresponding to said current engine speed.

7. A device according to claim 3, wherein:

said output torque correction amount to be estimated by said second estimation means includes an output torque correction amount in which a restoring force corresponding to a difference between said target engine speed and said current engine speed is taken into consideration.

8. A device according to claim 3, wherein:

said output torque correction amount to be estimated by said second estimation means includes an output torque correction amount in which a restoring force corresponding to a difference between said target engine speed and said current engine speed is taken into consideration, and in said restoring force, a response delay corresponding to a change in engine speed has been taken into consideration.

9. A device according to claim 3, wherein:

said output torque correction amount to be estimated by said second estimation means includes an output torque correction amount corresponding to a speed derivative which relies upon an internal inertia of said internal combustion engine.

10. A device according to claim 3, wherein:

said target output torque to be estimated by said target output torque estimation means is estimated by adding a product of said output torque correction amount, which has been estimated by said second estimation means, with a gain to said current output torque estimated by said first estimation means.

11. A device according to claim 3, wherein:

said target output torque to be estimated by said target output torque estimation means is estimated by adding a product of said output torque correction amount, which has been estimated by said second estimation means, with a gain to said current output torque estimated by said first estimation means; and said gain used in said target output torque estimation means is estimated in accordance with a ratio of a pressure downstream of a throttle to a pressure upstream of said throttle.

12. A device according to claim 1, wherein:

said output torque correlation value to be estimated by said first estimation means is a throttle opening equivalent to a current output torque corresponding to said present intake-air volume of said internal combustion engine;

said output torque correlation value correction amount to be estimated by said second estimation means is a throttle opening correction amount equivalent to an output torque correction amount corresponding to said difference between said current engine speed and said target engine speed of said internal combustion engine;

said third estimation means comprises a target throttle opening estimation means for estimating a target throttle opening on a basis of a throttle opening equivalent to said current output torque estimated by said first estimation means and said throttle opening correction amount equivalent to said output torque correction amount estimated by said second estimation means; and said control means controls said intake-air-volume adjusting system of said internal combustion engine to achieve said target throttle opening estimated by said target throttle opening estimation means.

13. A method for controlling an air volume during an idle operation of an internal combustion engine, which comprises:

a first step of estimating a current output torque correlation value corresponding to a present intake-air volume of said internal combustion engine during said idle operation of said internal combustion engine;

a second step of estimating an output torque correlation value correction amount corresponding to a difference between a current engine speed and a target engine speed of said internal combustion engine;

a third step of estimating a target output torque correlation value on a basis of said current output torque correlation value estimated in said first step and said output torque correlation value correction amount estimated in said second step; and a fourth step of controlling an intake-air-volume adjusting system of said internal combustion engine to achieve an intake-air volume which is equivalent to said target output torque correlation value estimated in said third step.

14. A method according to claim 13, wherein:

said method further comprises a conversion step of converting said target output torque correlation value, which has been estimated in said third step, into a value corresponding to said intake-air volume equivalent to said target output torque correlation value; and said fourth step controls said intake-air-volume adjusting system of said internal combustion engine to achieve a value which has been obtained in said conversion step and which corresponds to said intake-air volume equivalent to said target output torque correlation value.

15. A method according to claim 13, wherein:

said output torque correlation value to be estimated in said first step is a current output torque corresponding to said present intake-air volume of said internal combustion engine during said idle operation of said internal combustion engine;

said output torque correlation value correction amount to be estimated in said second step is an output torque correction amount corresponding to said difference between said current engine speed and said target engine speed of said internal combustion engine;

said third step estimates a target output torque on a basis of said current output torque estimated in said first step and said output torque correction amount estimated in said second step; and said fourth step controls said intake-air-volume adjusting system of said internal combustion engine to achieve an intake-air volume equivalent to said target output torque estimated in said third step.

16. A method according to claim 15, wherein:

said method further comprises a conversion step of converting said target output torque, which has been estimated in said third step, into a throttle opening equivalent to said target output torque; and said fourth step controls said intake-air-volume adjusting system of said internal combustion engine to achieve an intake-air volume corresponding to said throttle opening which has been obtained in said conversion step and which is equivalent to said target output torque.

17. A method according to claim 15, wherein:

said current output torque to be estimated in said first step is estimated as one that varies with a first-order delay, which corresponds to an entire volume of intake pipes in said internal combustion engine and a volume of cylinders in said internal combustion engine, relative to an intake-air volume estimated based on a throttle opening at present.

18. A method according to claim 15, wherein:

said output torque correction amount to be estimated in said second step includes an output torque correction amount based on a difference between an output torque corresponding to said target engine speed and an output torque corresponding to said current engine speed.

19. A method according to claim 15, wherein:

said output torque correction amount to be estimated in said second step includes an output torque correction amount in which a restoring force corresponding to a difference between said target engine speed and said current engine speed is taken into consideration.

20. A method according to claim 15, wherein:

said output torque correction amount to be estimated in said second step includes an output torque correction amount in which a restoring force corresponding to a difference between said target engine speed and said current engine speed is taken into consideration, and in said restoring force, a response delay corresponding to a change in engine speed has been taken into consideration.

21. A method according to claim 15, wherein:

said output torque correction amount to be estimated in said second step includes an output torque correction amount corresponding to a speed derivative which relies upon an internal inertia of said internal combustion engine.

22. A method according to claim 13, wherein:

said output torque correlation value to be estimated in said first step is a throttle opening equivalent to a current output torque corresponding to said present intake-air volume of said internal combustion engine;

said output torque correlation value correction amount to be estimated in said second step is a throttle opening correction amount equivalent to an output torque correction amount corresponding to said difference between said current engine speed and said target engine speed of said internal combustion engine;

said third step estimates a target throttle opening on a basis of a throttle opening equivalent to said current output torque estimated in said first step and said throttle opening correction amount equivalent to said output torque correction amount estimated in said second step; and said fourth step controls said intake-air-volume adjusting system of said internal combustion engine to achieve said target throttle opening estimated in said third step.

* * * * *